US006843708B2

(12) United States Patent
VanHanehem

(10) Patent No.: US 6,843,708 B2
(45) Date of Patent: Jan. 18, 2005

(54) METHOD OF REDUCING DEFECTIVITY DURING CHEMICAL MECHANICAL PLANARIZATION

(75) Inventor: Matthew R. VanHanehem, Bear, DE (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 22 days.

(21) Appl. No.: 10/393,070

(22) Filed: Mar. 20, 2003

(65) Prior Publication Data

US 2004/0185755 A1 Sep. 23, 2004

(51) Int. Cl.[7] ..... B24B 1/00
(52) U.S. Cl. ..... 451/41; 451/398
(58) Field of Search ..... 451/41, 57, 59, 451/287, 288, 398

(56) References Cited

U.S. PATENT DOCUMENTS

| | | | | |
|---|---|---|---|---|
| 5,584,751 A | * | 12/1996 | Kobayashi et al. | 451/288 |
| 6,116,992 A | | 9/2000 | Prince | |
| 6,220,930 B1 | * | 4/2001 | Lin et al. | 451/8 |
| 6,315,634 B1 | * | 11/2001 | Jensen et al. | 451/5 |
| 6,439,964 B1 | * | 8/2002 | Prahbu et al. | 451/8 |
| 6,602,436 B2 | * | 8/2003 | Mandigo et al. | 216/88 |

* cited by examiner

*Primary Examiner*—Dung Van Nguyen
(74) *Attorney, Agent, or Firm*—Blake T. Biederman

(57) ABSTRACT

A method of reducing defectivity during chemical mechanical planarization (CMP) in a system having a wafer membrane and a retaining ring is disclosed. The method includes planarizing test wafers using different values of ring pressure and wafer pressure to determine an optimum ring pressure and wafer pressure, i.e., the ring pressure and wafer pressure that results in a reduced defectivity.

8 Claims, 2 Drawing Sheets

METHOD OF REDUCING DEFECTIVITY DURING CHEMICAL MECHANICAL PLANARIZATION

FIELD OF THE INVENTION

The present invention relates to chemical-mechanical planarization (CMP), and in particular relates to methods of reducing defectivity during CMP of wafers.

BACKGROUND OF THE INVENTION

In the fabrication of integrated circuits and other electronic devices, multiple layers of conducting, semiconducting, and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the substrate may become non-planar across its surface and require planarization. Planarizing a surface, or "polishing" a surface, is a process where material is removed from the surface of the wafer to form a generally even, planar surface. Planarization is useful in removing undesired surface topography and surface defects, such as rough surfaces, agglomerated materials, crystal lattice damage, scratches, and contaminated layers or materials. Planarization is also useful in forming features on a substrate by removing excess deposited material used to fill the features and to provide an even surface for subsequent levels of metallization and processing.

Chemical mechanical planarization, or chemical mechanical polishing (CMP), is a common technique used to planarize substrates such as semiconductor wafers. In conventional CMP, a wafer carrier or polishing head is mounted on a carrier assembly and positioned in contact with a polishing pad in a CMP apparatus. The carrier assembly provides a controllable pressure to the substrate urging the wafer against the polishing pad. The pad is optionally moved (e.g., rotated) relative to the substrate by an external driving force. Simultaneously therewith, a polishing solution (e.g., a chemical composition, a "slurry" or other fluid medium) is flowed onto the substrate and between the wafer and the polishing pad. The wafer surface is thus polished by the chemical and mechanical action of the pad surface and slurry in a manner that selectively removes material from the substrate surface.

Different improvements to CMP systems have been proposed to improve the CMP process. One such improvement relevant to the invention described below is set forth in U.S. Pat. No. 6,116,992, which discloses a CMP system that utilizes a retaining ring to used to keep the wafer in place and to put pressure on an annular portion of the polishing pad surrounding the wafer to reduce edge polish non-uniformities.

A problem encountered when planarizing a wafer is the introduction of "defects" onto the wafer surface. These defects include scratches, pits, cracking, dishing, erosion, particles, etc. The presence of defects on a wafer surface is referred to as "defectivity." In the manufacturing of semiconductor devices, defectivity is known to reduce product yield, which in turn reduces profit. Accordingly, techniques that reduce defectivity during CMP processing tend to improve device yield, which in turn makes the manufacturing of semiconductor devices more profitable.

STATEMENT OF THE INVENTION

The invention is a method of performing chemical mechanical planarization (CMP) of a wafer having a surface to be planarized, comprising: a) supporting the wafer in a wafer carrier having a membrane and a retaining ring surrounding the membrane; b) bringing the wafer surface into contact with a surface of a polishing pad; c) providing relative motion between the wafer surface and the polishing pad; d) adjusting the membrane to provide a select wafer pressure between the wafer and the polishing pad; and e) adjusting the retaining ring to provide a ring pressure between the retaining ring and the polishing pad that is at least 1.5 times the wafer pressure to reduce defectivity on the wafer surface.

DETAILED DESCRIPTION OF THE INVENTION

Figure 1:
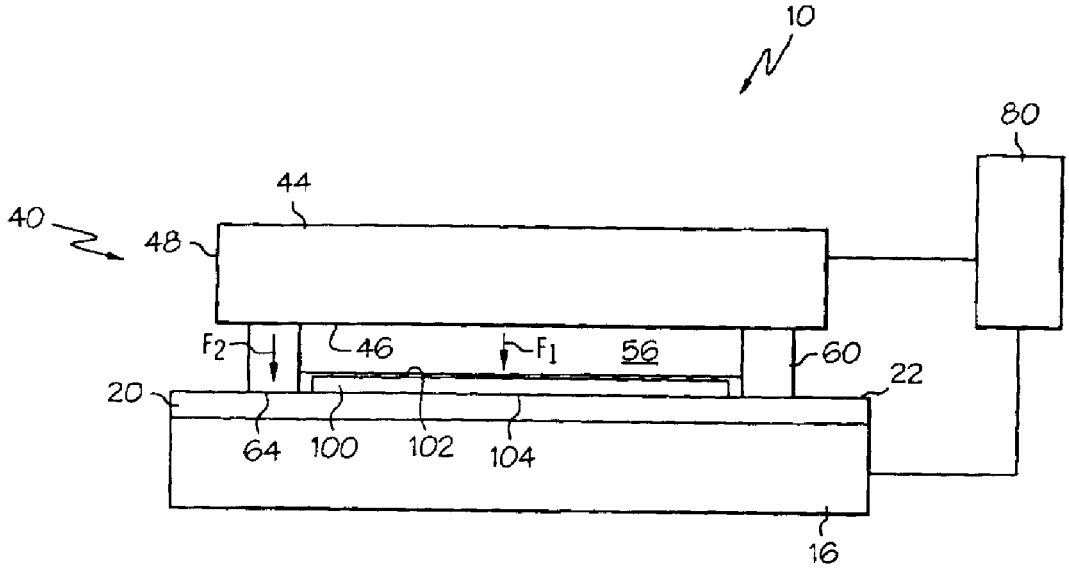
FIG. 1 is a schematic cross-sectional view of an embodiment of a CMP apparatus that includes an inflatable/deflatable membrane and a retaining ring.

FIG. 1 is a schematic cross-sectional view of an embodiment of a CMP apparatus 10. Apparatus 10 includes a platen 16 upon which resides a polishing pad 20 having a polishing (e.g., roughened) surface 22. Apparatus 10 also includes a wafer carrier 40 having a horizontal support member 44 with a side 46 and a perimeter 48. An inflatable/deflatable membrane 56 is fixed to side 46. Apparatus 10 also includes an adjustable retaining ring 60 movably attached to support member 44 near perimeter 48. Retaining ring 60 surrounds membrane 56. Retaining ring 60 extends downward from side 46 to surround membrane 56. Retaining ring 60 has an annular end 64 that contacts polishing pad surface 22 over an annular region surrounding a wafer (e.g., wafer 100, discussed below) during polishing.

Apparatus 10 also includes a controller 80 operatively connected to platen 16 and wafer carrier 40 to control the movement (e.g., rotation) of the platen and the rotation and movement of the wafer carrier, as well as the inflation and deflation of membrane 56 and the downward movement of retaining ring 60 to adjust the downward force of the retaining ring on polishing pad 20. As described above, the conventional purpose of retaining ring 60 is to provide pressure on the region of the polishing pad near the edge of the wafer to reduce non-uniformity in the polishing rate near the edge of the wafer.

In the operation of apparatus 10, a wafer 100 with an upper surface 102 and a lower surface 104 is held in wafer carrier 40. Wafer surface 104 is the surface to be planarized. Wafer 100 is held in wafer carrier 40 such that surface 102 contacts membrane 56 and surface 104 is pressed against polishing pad surface 22. In an example embodiment, a slurry (not shown) containing an abrasive is introduced between wafer surface 104 and polishing pad surface 22 to enhance the planarization process.

Platen 16 and wafer carrier 40 are placed in relative rotation while the wafer and polishing pad are pressed together, resulting in the planarization of wafer surface 104. The presence of a slurry enhances the planarization process. The inflation or deflation of membrane 56 adjusts the amount of force F1 on wafer 100 and thus the amount of pressure between wafer surface 104 and polishing pad surface 22. Also, extending or retracting retaining ring 60 into or from the polishing pad adjusts the amount of force F2 retaining ring 60 exerts on polishing pad surface 22 and thus the amount of pressure between retaining ring end 64 and an annular portion of the polishing pad surface surrounding the wafer.

The pressure (i.e., forcer per unit area, usually measured in pounds per square inch or "psi") between wafer 100 and polishing pad 20 as adjusted by the inflation/deflation of membrane 56 is referred to herein as the "wafer pressure," or $P_W$. The pressure between retaining ring 60 and polishing pad 20 as adjusted by changing the downward force of the retaining ring on the polishing pad is referred to herein as the "ring pressure," or $P_R$.

While the wafer pressure $P_W$ and the ring pressure $P_R$ are independently adjustable, conventionally the two pressures are coupled to one another, e.g., $P_R$ is a fixed percentage of $P_W$. In practice, $P_R$ is made slightly larger than $P_W$ to reduce the non-uniformity of the polishing rate at the edge of the wafer.

By way of example, in one conventional CMP application, the relationship $P_R=(1.076)P_W-0.145$ is maintained. In another conventional example embodiment, $P_R=1.4P_W$.

The present invention, however, goes against the conventional wisdom in the art and does away with slavishly coupling the ring pressure from the wafer pressure for the sole purpose of achieving edge polish uniformity. De-coupling of $P_R$ and $P_W$ allows for these pressures to be selected to additionally reduce defectivity while also maintaining edge polish uniformity.

Figure 2:
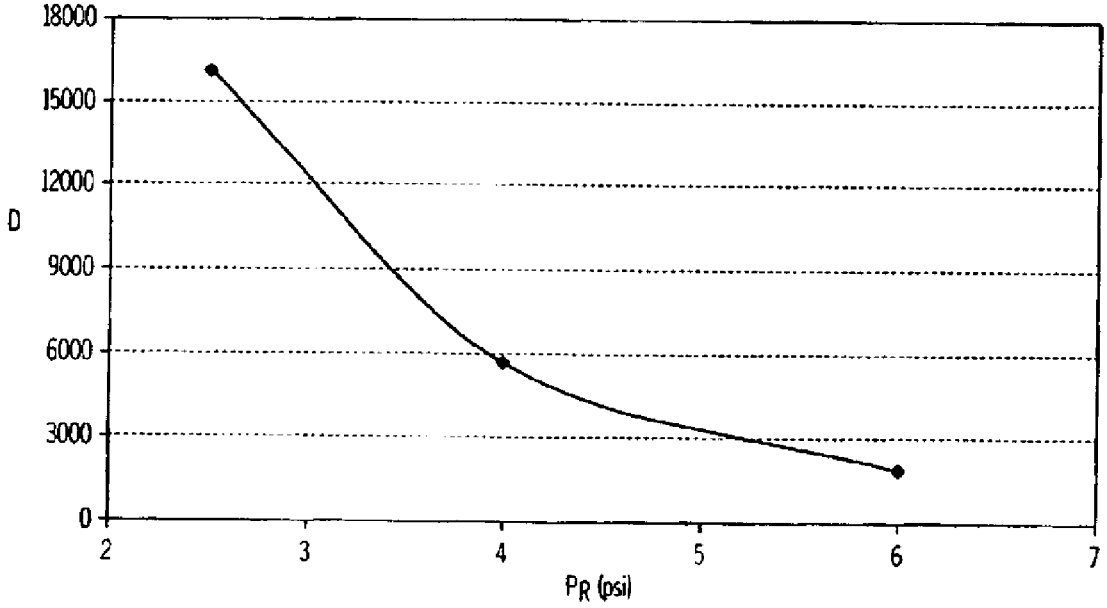
FIG. 2 is a plot of total defect count D vs. ring pressure $P_R$ (psi) for a fixed wafer pressure $P_W$ of 2 psi for a CMP process performed on copper sheet wafers, illustrating a significant reduction in wafer defectivity with increasing ring pressure $P_R$.

FIG. 2 is a plot of total defect count D vs. ring pressure $P_R$ for a fixed wafer pressure $P_W$ of 2 psi for a CMP process performed on copper sheet wafers using a slurry known as CUS1351, manufactured by Rodel, Inc. of Newark, Del. Measurements of the processed wafers showed that the vast majority of the defects were microscratches. From the plot, it is clear that increasing the ring pressure $P_R$, e.g., to 3 times the wafer pressure $P_W$ results in a dramatic reduction in defectivity.

In practice, the ring pressure $P_R$ and the wafer pressure $P_W$ are set by inputting instructions into controller 80. In an example embodiment, controller 80 has a range (tolerance) for possible ring and wafer pressures, and the combination of pressures that reduces defectivity are determined empirically using test wafers. Once the select pressure settings that reduce defectivity are established, the CMP process can then be carried out on product wafers. In an example embodiment, the test wafers are the same type of wafers as the product wafers. In another example embodiment, the test wafers are sheet wafers representative of the product wafers. In yet another example embodiment, the test wafers are copper sheet wafers.

Advantageously, the ring pressure $P_R$ is set at least 1.5 times the wafer pressure $P_W$ to decrease defectivity. Increasing this ratio to at least 3 provides a further decrease in wafer defectivity. In a most advantageous embodiment, the ring pressure $P_R$ is set between 3 and 10 times the wafer pressure $P_W$.

Thus, an example embodiment of a method of the present invention for performing CMP of a wafer (e.g., wafer 100) to reduce defectivity includes supporting the wafer in wafer carrier 40, and bringing the wafer surface (e.g., surface 104) into contact with surface 22 of polishing pad 20. The method further includes providing relative motion between the wafer surface and the polishing pad, adjusting membrane 56 (e.g., via inflation or deflation) to provide a select wafer pressure $P_W$ between the wafer and the polishing pad, and adjusting retaining ring 60 to provide a ring pressure $P_R$ that reduces defectivity on the wafer surface.

In another example embodiment, the method further includes providing a polishing solution between wafer surface 104 and polishing pad surface 22 to enhance planarization of the wafer surface.

Another example embodiment of the present invention is a method of planarizing a surface of a product wafer to reduce defectivity on the surface of the product wafer. The method includes planarizing two or more test wafers, with each test wafer being subject to a select ring pressure and a select wafer pressure. The method further includes performing defectivity measurements on the two or more test wafers, and establishing the ring and wafer pressures from the defectivity measurements that show reduced defectivity. The method further includes planarizing the product wafer using the ring pressures and wafer pressures that resulted in the reduced defectivity (i.e., the aforementioned "established" pressures).

Another example embodiment of the present invention is a method of determining a ring pressure and a wafer pressure for performing chemical mechanical polishing in a manner that results reduced wafer defectivity. The method includes producing a set of planarized test wafers, with each test wafer planarized with a select ring pressure $P_R$ and a select wafer pressure $P_W$, performing defectivity measurements on the set of test wafers to determine which test wafer has reduced defectivity, and then identifying the ring pressure and wafer pressure used to planarize the test wafer having reduced defectivity.

What is claimed is:

1. A method of performing chemical mechanical planarization (CMP) of a wafer having a surface to be planarized, comprising:

a) supporting the wafer in a wafer carrier having a membrane and a retaining ring surrounding the membrane;

b) bringing the wafer surface into contact with a surface of a polishing pad;

c) providing relative motion between the wafer surface and the polishing pad;

d) adjusting the membrane to provide a selected wafer pressure between the wafer and the polishing pad; and e) adjusting the retaining ring to provide a ring pressure between the retaining ring and the polishing pad that is between 3 and 10 times the wafer pressure to reduce defectivity on the wafer surface.

2. The method of claim 1, further including providing a polishing solution between the wafer surface and the polishing pad to enhance planarization of the wafer surface.

3. The method of claim 1, including repeating acts a) through e) for two or more test wafers and varying the selected wafer pressure and the ring pressure to establish the ring pressure and the wafer pressure.

4. The method of claim 3, including repeating acts a) through d) on a product wafer using the established ring and wafer pressures.

5. A method of planarizing a surface of product wafer to reduce defectivity, comprising:

planarizing two or more test wafers, with each test wafer being subject to a selected ring pressure and a selected wafer pressure;

performing defectivity measurements on the two or more test wafers;

establishing a ring pressure and wafer pressure from the defectivity measurements associated with a reduced defectivity, the ring pressure being between 3 and 10 times the wafer pressure; and planarizing the product wafer using the established ring and wafer pressures.

6. The method of claim 5, wherein the product wafer and the two or more test wafers are the same type of wafer.

7. The method of claim 5, wherein the test wafers are sheet wafers representative of the product wafers.

8. A method of determining a ring pressure and a wafer pressure for performing chemical mechanical planarization (CMP) in a manner that results in reduced wafer defectivity, comprising:

producing a set of planarized test wafers, with each test wafer planarized with a selected ring pressure and a selected wafer pressure;

performing defectivity measurements on the set of test wafers to determine which test wafer has a reduced defectivity; and identifying the ring pressure and wafer pressure used to planarize the test wafer having the reduced defectivity, the ring pressure being between 3 and 10 times the wafer pressure.

* * * * *